US010442066B2

(12) United States Patent
Nishikawa et al.

(10) Patent No.: US 10,442,066 B2
(45) Date of Patent: Oct. 15, 2019

(54) DRIVER

(71) Applicant: Hitachi Koki Co., Ltd., Tokyo (JP)

(72) Inventors: Tomomasa Nishikawa, Hitachinaka (JP); Yoshiichi Komazaki, Hitachinaka (JP); Tetsuhiro Harada, Hitachinaka (JP); Norikazu Baba, Hitachinaka (JP)

(73) Assignee: Koki Holdings Co., Ltd., Tokyo (JP)

( * ) Notice: Subject to any disclaimer, the term of this patent is extended or adjusted under 35 U.S.C. 154(b) by 417 days.

(21) Appl. No.: 15/507,279

(22) PCT Filed: Aug. 21, 2015

(86) PCT No.: PCT/JP2015/073534
§ 371 (c)(1),
(2) Date: Feb. 28, 2017

(87) PCT Pub. No.: WO2016/031716
PCT Pub. Date: Mar. 3, 2016

(65) Prior Publication Data

US 2017/0297187 A1 Oct. 19, 2017

(30) Foreign Application Priority Data

Aug. 28, 2014 (JP) ..... 2014-174400

(51) Int. Cl.
*B25C 5/10* (2006.01)
*B25C 1/06* (2006.01)
(Continued)

(52) U.S. Cl.
CPC . *B25C 1/06* (2013.01); *B25C 7/00* (2013.01)

(58) Field of Classification Search
CPC .... B25C 1/00; B25C 1/06; B25C 5/10; B25C 5/15
(Continued)

(56) References Cited

U.S. PATENT DOCUMENTS 3,924,692 A * 12/1975 Saari ..... B25C 1/06 173/117
5,443,196 A * 8/1995 Burlington ..... B25C 1/06 173/124
(Continued)

FOREIGN PATENT DOCUMENTS

CN 102642192 A 8/2012
CN 102773835 A 11/2012
(Continued)

OTHER PUBLICATIONS

International Report on Patentability for application PCT/JP2015/073534 (dated Mar. 9, 2017), 6 pages.
(Continued)

*Primary Examiner* — Gloria R Weeks
(74) *Attorney, Agent, or Firm* — Kilpatrick Townsend & Stockton LLP

(57) ABSTRACT

In order to provide a driver for reducing reaction generated to a driver main body, the driver 1 includes a nose portion 3 provided in a housing 2 and extending in a longitudinal direction, the nose portion being configured to allow a fastener to pass therethrough, a plunger 7 configured to move in an impact direction parallel to the longitudinal direction to impact the fastener through the nose portion, a weight 8, and a coil spring 9 configured to be compressed by a motor 5 in the longitudinal direction. a release of the compression causing the plunger 7 to move in the impact direction, while causing the weight 8 to move in a counter-impact direction which is away from the plunger 7. The coil spring 9 is provided between the plunger 7 and the weight 8. The coil spring has one end portion urging the plunger 7, and another end portion urging the weight 8.

7 Claims, 9 Drawing Sheets

(51) Int. Cl.
*B25C 7/00* (2006.01)
*B25C 1/00* (2006.01)

(58) Field of Classification Search
USPC ..... 227/132
See application file for complete search history.

(56) References Cited

U.S. PATENT DOCUMENTS 6,123,243 A * 9/2000 Pfister ..... B25C 1/14 227/10
6,705,503 B1 * 3/2004 Pedicini ..... B25C 1/06 173/124
6,971,567 B1 * 12/2005 Cannaliato ..... B25C 1/06 173/1
7,121,443 B2 * 10/2006 Sun ..... B25C 1/06 227/131
7,377,331 B2 * 5/2008 Chen ..... B25B 21/00 173/104
7,445,139 B2 * 11/2008 Okouchi ..... B25C 1/06 227/132
7,513,407 B1 * 4/2009 Chang ..... B25C 1/06 173/202
7,832,610 B2 * 11/2010 Tanimoto ..... B25C 1/06 227/131
7,938,305 B2 * 5/2011 Simonelli ..... B25C 1/06 227/129
8,840,002 B2 * 9/2014 Ito ..... B25C 1/06 227/138
8,978,953 B2 * 3/2015 Blessing ..... B25C 1/003 227/156
2004/0231869 A1 * 11/2004 Bernhart ..... B25D 17/00 173/210
2008/0121404 A1 * 5/2008 Spasov ..... B25C 1/06 173/202
2008/0296339 A1 12/2008 Fielitz et al.
2009/0236387 A1 9/2009 Simonelli et al.
2010/0001032 A1 * 1/2010 Miescher ..... B25C 1/008 227/8
2012/0211540 A1 8/2012 Kondou et al.
2015/0258671 A1 9/2015 Kondou et al.

FOREIGN PATENT DOCUMENTS

JP 09-295283 A 11/1997
JP 2008-260124 A 10/2008
JP 2011-056613 A 3/2011
JP 2012-183632 A 9/2012
JP 2012-236250 A 12/2012
JP 2013-154452 A 8/2013
JP 2014-108468 A 6/2014
RO 122772 B1 1/2010

OTHER PUBLICATIONS

International Search Report for international application PCT/JP2015/073534 (dated Nov. 2, 2015).
European Patent Office Extended Search for EP15835951.3 dated Apr. 10, 2018, 7 pages.

* cited by examiner

DRIVER

TECHNICAL FIELD

The present invention relates to a driver, and more particularly, to a driver provided with a weight.

BACKGROUND

A conventional driver is known in the art. The driving includes a plunger 7 for striking a nail, a nose portion 3 formed with an ejection hole through which the nail hit by the plunger 7 is ejected, a spring configured to urge the plunger 7 in an impact direction, and a motor used for accumulating an resilient energy in the spring (See Patent Literature 1). According to such driver, driving force of the motor causes the spring to accumulate the resilient energy. Release of the resilient energy causes the plunger 7 to be accelerated in the impact direction, thereby striking the nail to a workpiece such as boards made of wood or gypsum. The striking operation is performed with the ejection hole being in abutment with the workpiece.

CITATION LIST

Patent Literature

Patent Literature 1: Japanese Patent Application Publication 2011-56613

SUMMARY OF INVENTION

In the above driver, when the plunger 7 is accelerated in the impacting direction, a reaction force is generated and applied to a driver main body by the reaction against the acceleration of the plunger 7. Therefore, the ejection hole is moved away from the workpiece. Thus, it is difficult to strike the nail in a direction perpendicular to the surface of the workpiece, while maintaining a posture of the driver main body. Alternatively, the operation is a heavy burden to the user. In order to restrict the reaction, the user presses the ejection hole against the workpiece excessively, which would lead to a damage to the workpiece. Accordingly finishing to the workpiece may be degraded.

It is therefore, an object of the present invention is to provide a driver capable of reducing reactive force occurring in the driver main body, with enhancing workability, and providing desirable finishing.

Solution to Problem

In order to solve the above problems, the invention provides a driver comprising: a nose portion 3 provided in a housing 2 and extending in a longitudinal direction, the nose portion being configured to allow a fastener to pass therethrough; a plunger 7 configured to move in an impact direction parallel to the longitudinal direction to impact the fastener through the nose portion 3; a weight 8; and a resilient member configured to be compressed by a motor in the longitudinal direction, a release of the compression in the resilient member causing the plunger 7 to move in the impact direction, while causing the weight 8 to move in a counter-impact direction which is away from the plunger. The resilient member is provided between the plunger 7 and the weight 8, the resilient member having one end portion and another end portion in the longitudinal direction, the one end portion being configured to urge the plunger 7, and the another end portion being configured to urge the weight 8.

According to the above configuration, for driving the fastener by the nail fastening driver 1, the resilient member is compressed by the motor in the longitudinal direction. Then, when the compression is released, the resilient energy accumulated in the resilient member causes the plunger 7 to move in the impact direction and then strike the fastener into the workpiece, and causes the weight 8 to move in a counter-impact direction. The forces generated by the movement of the plunger 7 and the weight 8 are cancelled to each other, so that a reaction force does not directly exert on the housing 2. Accordingly, the lifting up of the housing 2 from the workpiece is prevented. The strike operation can be finished, while maintaining orientation of the nose portion 3 to the workpiece, thereby improving workability of the driver.

Further, during driving the fastener, the housing 2 is not lifted up from the workpiece. Therefore, a user can perform the strike operation without excessively urging the nose portion 3 against the workpiece. This can reduce generation of pressure mark on the surface of the workpiece, so that finishing is improved after striking the fastener to the workpiece.

Further, the resilient member is provided between the plunger 7 and the weight 8. Accordingly, the configuration is simple, and the driver can be manufactured at a low cost.

Further, the resilient member has the one end in the longitudinal direction which urges only the plunger 7, and the another end which urges only the weight 8. Therefore, lifting up of the housing 2 from the workpiece during the strike operation can be restrained. Further, the stroke of the plunger can be ensured by properly determining the weight of the plunger 7 and the weight 8.

Preferably, the resilient member comprises a single coil spring. The single coil spring allows each of the plunger 7 and the weight 8 to be movable. Therefore, the number of parts constituting the driver can be reduced, and the driver can be manufacture at a low cost.

Preferably, the driver further comprises a drive mechanism configured to cause a motor to compress the resilient member in the longitudinal direction. The drive mechanism is configured to release compression of the resilient member to cause the plunger 7 to start moving in the impact direction, and simultaneously cause the weight 8 to start moving in the counter-impact direction.

With the above structure, the force generated by the movement of the plunger 7 in the impact direction is cancelled with the force generated by the movement of the weight 8 in the counter-impact direction, so that a reaction force is not exerted on the housing 2 directly. Accordingly, a user can perform the strike operation without pressing the nose portion 3 against the workpiece excessively in an attempt to avoid lifting up the housing 2. Thus, the generation of a pressure mark on the workpiece can be reduced, and finishing after striking the fastener into the workpiece can be improved.

Preferably, the driver further comprises a drive mechanism configured to cause the motor to compress the resilient member in the longitudinal direction. The drive mechanism is configured to release compression of the resilient member from the another end portion to cause the weight 8 to start moving in the counter-impact direction, and then the drive mechanism is configured to release compression of the resilient member from the one end portion to cause the plunger 7 to move in the impact direction.

With the above configuration, as the weight 8 firstly starts moving in the counter impact direction, a reaction by the movement of the weight 8 urges the nose portion 3 of the housing 2 to be directed to the workpiece in the impact direction. Accordingly, this operation prevents the nose portion 3 from being deviated from a target position for the fastener. When the plunger 7 starts moving in the impact direction, the force generated by the movement of the weight 8 in the counter-impact direction is cancelled with the force generated by the movement of the plunger 7 in the impact direction. As a result, urging of the housing 2 to the workpiece is ceased. Accordingly, when the fastener is to be driven to a side surface of the workpiece or the fastener is oriented upward, the strike operation can be performed while preventing the nose portion 3 from being deviated from the target strike position on the workpiece without urging the nose portion 3 to the workpiece excessively. Further, the generation of a pressure mark on the workpiece can be reduced, and finishing after striking the fastener into the workpiece can be improved.

Preferably, the driver further comprises a weight restriction member provided in the housing 2 and configured to restrict further movement of the weight 8 in the counter-impact direction. The weight 8 is configured to be in abutment with the weight restriction member after the plunger 7 strikes the fastener.

With the above structure, as the weight 8 is in abutment with the restriction member after the striking of the fastener, the force generated by the movement of the weight 8 in the counter-impact direction after the striking of the fastener exerts on the housing 2 as a reaction force. The reaction force lifts up the housing 2 from the workpiece after the strike operation is over, so that finishing to the surface of the workpiece can be improved.

Preferably, the driver further comprises a plunger restriction member provided in the housing 2 and configured to restrict movement of the plunger 7 in the impact direction. The plunger and the weight are provided in the housing in such a manner that a moving distance of the plunger 7 to the plunger restriction member is set longer than a moving distance of the weight 8 to the weight restriction member.

With the above structure, moving distance of the weight can be shortened while obtaining sufficient stroke which is necessary for striking the fastener, and accordingly, a compact housing 2 of the driver can result.

Advantageous Effects of Invention

In the driver according to the present invention, the force generated by the movement of the plunger 7 in the impact direction is cancelled with the force generated by the movement of the weight 8 in the counter-impact direction. Accordingly, the present invention exhibits the advantages that the action of the reaction force to the housing 2 can be suppressed.

A side view of a nail fastening driver according to the invention in which a plunger 7 is positioned at a bottom dead center.

[FIG. 2]

Figure 1:
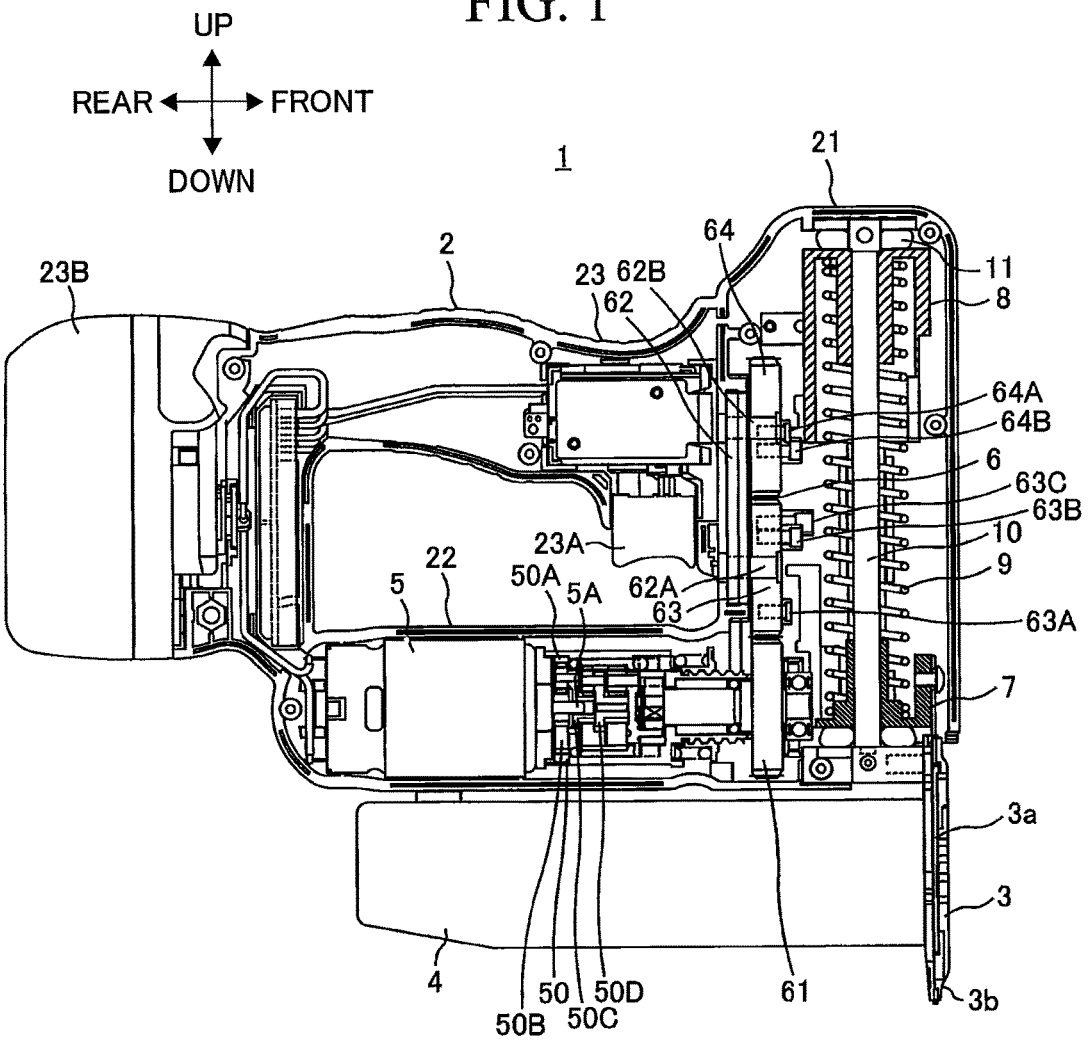
[FIG. 1]

A side view of the nail fastening driver in which the plunger 7 shown in FIG. 1 is positioned at a top dead center.

[FIG. 3]

A perspective view of the plunger 7 of the nail fastening driver shown in FIG. 1.

[FIG. 4]

A perspective view of a weight 8 of the nail fastening driver shown in FIG. 1.

[FIG. 5]

A perspective view of the nail fastening driver shown in FIG. 1.

[FIG. 6]

Figures (a) to (h) are time series chart showing operations of a drive mechanism, a plunger 7, and a weight 8 of the nail fastening driver shown in FIG. 1. Particularly, Figure (g) is a view showing the situation in which compression of a coil spring 9 is released, and the plunger 7 and the weight 8 start moving by means of urging force of the coil spring 9.

[FIG. 7]

Figures (a) to (d) are time series chart showing conditions of the plunger 7, and the weight 8 of the nail fastening driver shown in FIG. 1. Particularly, Figure (a) is a view showing the situation in which the coil spring 9 urges the plunger 7 and the weight 8 to start moving. Figure (d) is a view showing the situation in which an impact operation by the plunger 7 is over, and the weight 8 is in abutment with a bumper to absorb a reaction force.

[FIG. 8]

Figures (a) to (i) are time series chart showing operations of the drive mechanism, the plunger 7, and the weight 8 of the nail fastening driver shown in FIG. 1. Particularly, Figure (g) is a view showing the situation in which compression of the coil spring 9 is released, and the coil spring 9 urges the weight 8 to start moving on ahead. Figure (h) is a view showing the condition in which compression of the coil spring 9 is released after Figure (g), and the coil spring 9 urges the plunger 7 to start moving.

[FIG. 9]

Figures (a) to (d) are time series chart showing operations of the drive mechanism, the plunger 7, and the weight 8 of the nail fastening driver shown in FIG. 1. Particularly, Figure (b) is a view showing the situation in which the coil spring 9 urges the weight 8 to start moving. Figure (c) is a view showing the condition in which the coil spring 9 urges the plunger 7 to start moving.

[FIG. 10]

Figure 9:
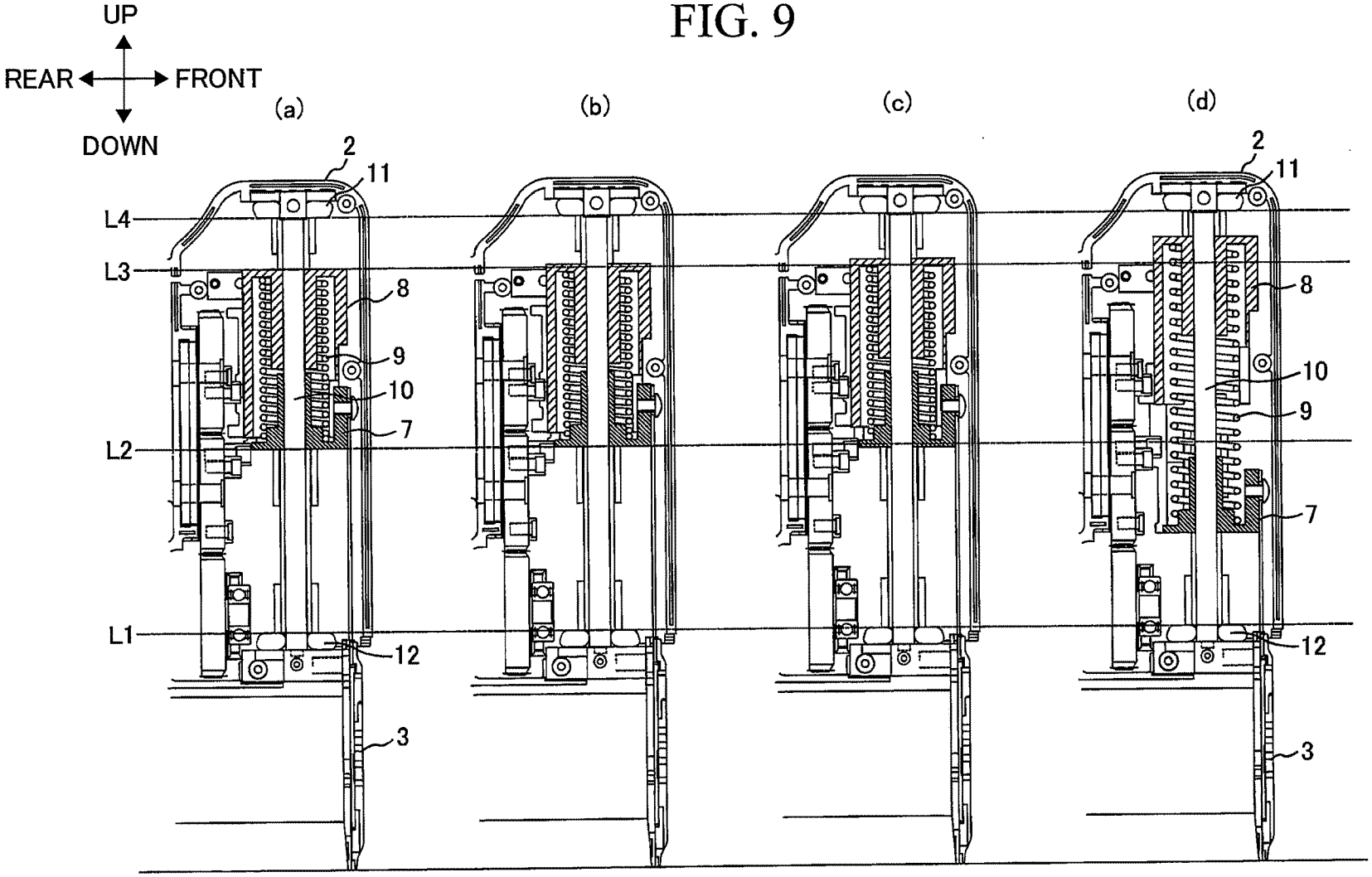

Figures (e) to (g) are time series chart showing operations subsequent to the movements of the drive mechanism, the plunger 7, and the weight 8 of the nail fastening driver shown in FIG. 9. Figure (e) is a view showing the plunger 7 reaching a bottom dead center. Figure (f) is a view showing the weight reaching a topmost point. Figure (g) is a view showing the situation in which a housing 2 floats above a workpiece.

EMBODIMENTS OF INVENTION

An electric nail fastening driver 1 to which the present invention is applied will be described. The nail fastening driver 1 is an electrically powered tool used to drive a nail as a fastener into a workpiece W such as boards made of wood or gypsum.

The nail fastening driver 1 primarily includes a housing 2 for accommodating a motor, a nose portion 3 provided in the housing 2 for ejecting the nail, and a magazine 4 for supplying the nail to the nose portion 3. Incidentally, in FIG. 1, a direction in which the magazine 4 is provided with respect to the nose portion 3 is defined as the rearward direction, while the opposite direction will be defined as the frontward direction. And a direction in which the nose portion 3 of the housing 2 faces the workpiece W is defined as the downward direction, while the opposite direction will be defined as the upward direction. Further, the left side as viewed the nail fastening driver 1 from rearward is defined as the leftward direction, and the right side is defined as the rightward direction.

As shown in FIG. 1, the housing 2 accommodates a motor 5, a drive mechanism 6, a plunger 7, a weight 8, and a coil spring 9. The housing 2 is formed of a resin, such as nylon or polycarbonate. The housing 2 includes a main body 21 provided in front of the housing 2 and extending in an upward/downward direction, a motor housing 22 extending rearward from a rear and lower portion of the main body 21, and a handle portion 23 extending rearward from a rear and upper portion of the main body 21.

The motor housing 22 accommodates therein the motor 5 and a deceleration mechanism 50. The motor 5 has a rotation shaft 5A extending in the frontward/rearward direction and is located in the rear portion of the motor housing 22.

The deceleration mechanism 50 is connected to the rotation shaft 5A at a position in front of the motor 5. The deceleration mechanism 50 is configured of a planetary gear mechanism including two planet gears 50A arranged around the rotation shaft 5A, a ring gear 50B arranged coaxially with the rotation shaft 5A, and a carrier 50C provided with a carrier gear 50D rotating coaxially with the rotation shaft 5A. The planet gear 50A is rotatably supported to the carrier 50C to orbitally move about the rotation shaft 5A. The orbital movement of the planet gear 50A decelerates the rotation speed of the rotation shaft 5A. Further, the orbital movement of the rotation shaft 5A causes rotation of the carrier gear 50D through the carrier 50C.

The handle portion 23 is configured to be gripped by a user when the user uses the nail fastening driver 1. A trigger 23A is provided at a front lower portion of the handle portion 23 for starting the supply of electric power to the motor 5. A battery 23B for supplying electric power to the motor 5 is detachably attached to the rear end portion of the handle portion 23.

A guide shaft 10 is provided within the main body 21 in such a manner that its longitudinal direction is oriented parallel to the upward/downward direction. The plunger 7, the coil spring 9, and the weight 8 allow the guide shaft 10 to be inserted therethrough in this order upward in the main body 21. The main body 21 further includes the drive mechanism 6.

The drive mechanism 6 is provided between the motor 5 and the guide shaft 10 in the main body 21, and configured of a driving gear 61, a gear holder 62, a first gear 63, and a second gear 64. The gear holder 62 is fixed to the main body 21, and includes a support shaft 62A and a support shaft 62B. The support shaft 62A protrudes frontward from the lower portion of the gear holder 62. The support shaft 62B protrudes frontward at a position above the support shaft 62A.

The first gear 63 is rotatably supported to the support shaft 62A, and is connected to the deceleration mechanism 50 through the driving gear 61. The rotation of the driving gear 61 causes rotation of the first gear 63 in a counterclockwise direction as viewed from the front. The first gear 63 is provided with a first roller-cam 63A, a second roller-cam 63B, and a third roller-cam 63C which are positioned at an imaginary circle whose center is coincident with an axis of the first gear 63 and arrayed in the circumferential direction at predetermined intervals and protrude frontward, respectively. The protruding length of each of the first roller-cam 63A, the second roller-cam 63B, and the third roller-cam 63C in the axial direction is different from each other.

The second gear 64 is rotatably supported to the second gear 64 and meshingly engaged with the first gear 63. The rotation of the first gear 63 causes rotation of the second gear 64 in a clockwise direction as viewed from the front. The second gear 64 has a first roller-cam 64A and a second roller-cam 64B which are positioned at an imaginary circle whose center is coincident with an axis of the second gear 64 and arrayed in the circumferential direction at intervals and protrude frontward, respectively. The protruding length of each of the first roller-cam 64A and the second roller-cam 64B in the axial direction is different from each other.

The guide shaft 10 has one end and the other end in the longitudinal direction, the one end being fixed to the inside of the upper end portion of the main body 21, and the other end being fixed to the inside of the lower end portion of the main body 21. A weight bumper 11 with which the weight 8 is abuttable is attached to one end portion of the guide shaft 10 as a weight restriction member. The weight bumper 11 is adapted to absorb the impact generated when the weight 8 collides against the housing 2. A plunger bumper 12 with which the plunger 7 is abuttable is provided at the other end portion of the guide shaft 10 as the plunger restriction member. The plunger bumper 12 is adapted to absorb the impact generated when the plunger 7 strikes the fastener.

Figure 3:
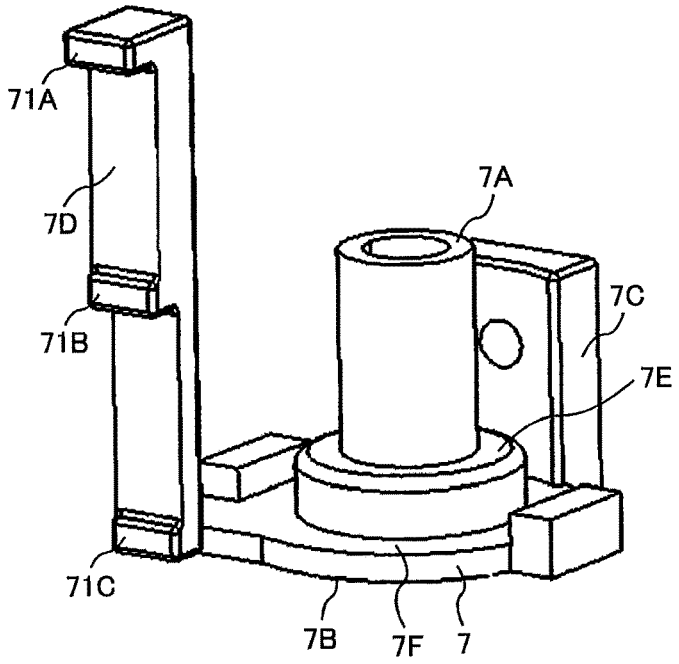

The plunger 7 is configured to strike the fastener in an impact direction which is parallel to the longitudinal direction of the guide shaft 10, and allows the guide shaft 10 to be inserted therethrough. As shown in FIG. 3, the plunger 7 has a cylindrical portion 7A through which the guide shaft 10 is slidably inserted, a bottom portion 7B in abutment with the plunger bumper 12, a rod attachment portion 7C extending from a peripheral portion of the bottom portion 7B to face the cylindrical portion 7A, and an engaging portion 7D extending from a peripheral portion of the bottom portion 7B to face the cylindrical portion 7A and engageable with the first gear 63. The bottom portion 7B is provided with an abutment portion 7E with which one end portion of the coil spring 9 is abutted. The one end (an end portion) of the coil spring 9 is seated on a support portion 7F. The abutment portion 7E is formed coaxially with the cylindrical portion 7A. A first abutment portion 71A, a second abutment portion 71B, and a third abutment portion 71C are provided at the outer periphery of the engaging portion 7D and are spaced away from each other in the longitudinal direction of the plunger 7.

The first abutment portion 71A protrudes rearward from the outer peripheral surface of the engaging portion 7D. The lower surface of the first abutment portion 71A is abuttable with the first roller-cam 63A of the first gear 63. The second abutment portion 71B also has a flat plate shape and protrudes rearward from the outer peripheral surface of the engaging portion 7D. The second abutment portion 71B is positioned lower than the first abutment portion 71A and is abuttable with the second roller-cam 63B of the first gear 63. The third abutment portion 71C also has a flat plate shape and protrudes rearward from the outer peripheral surface of the engaging portion 7D at a position below the second abutment portion 71B. The second abutment portion 71B is abuttable with the third roller-cam 63C of the first gear 63.

The rod 13 for directly striking the nail is made from metal, and is attached to the rod attachment portion 7C, and is slidably movable within the nose portion 3.

Figure 4:
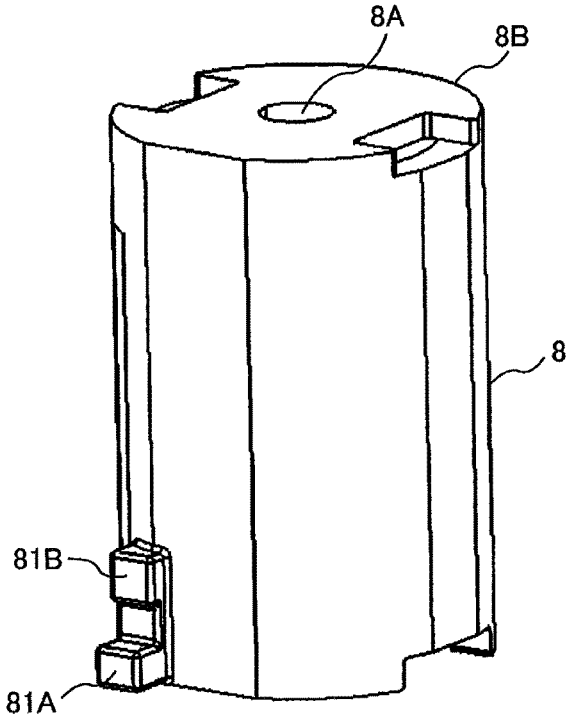

The weight 8 is adapted to receive a reaction force generated when the plunger 7 strikes, and functions as a reaction weight, and made from a metal. The weight 8 allows the guide shaft 10 to be inserted therethrough so as to be movable in a counter-impact direction which is away from the plunger 7. As shown in FIGS. 1 and 4, the weight 8 includes an inner sleeve portion 8A and an outer sleeve portion 8B both of which extend in the upward/downward direction as an axial direction. The inner sleeve portion 8A is connected coaxially with the outer sleeve portion 8B, and allows the guide shaft 10 to be slidably inserted therethrough. The coil spring 9 is inserted between the inner sleeve portion 8A and the outer sleeve portion 8B. A first abutment portion 81A and a second abutment portion 81B are provided on the lower end portion of the outer peripheral surface of the outer sleeve portion 8B such that the first and second abutment portions 81A and 81B are arrayed in the upward/downward direction. The first abutment portion 81A is abuttable with the first roller-cam 64A of the second gear 64, and the second abutment portion 81B is abuttable with the second roller-cam 64B of the second gear 64.

The first abutment portion 81A protrudes rearward from the outer peripheral surface of the weight 8. The upper surface of the first abutment portion 81A is abuttable with the first roller-cam 64A of the second gear 64. The second abutment portion 81B has a plate shape and protrudes rearward from the outer peripheral surface of the weight 8. The second abutment portion 81B is positioned above the first abutment portion 81A, and is abuttable with the second roller-cam 64B of the second gear 64.

The coil spring 9 is a single coil spring which accumulates an resilient energy when being compressed. When its compression is released, the accumulated energy is released. The coil spring 9 allows the guide shaft 10 to be inserted therethrough, and is positioned between the weight 8 and the plunger 7. The other end portion of the coil spring 9 is fitted with the outer peripheral surface of the inner sleeve portion 8A of the weight 8, and urges the weight 8 to the counter-impact direction. On the other hand, one end portion of the coil spring 9 is in abutment with the abutment portion 7E of the plunger 7 to urge the plunger 7 in the impact direction. When the coil spring 9 is in the compressed condition, the coil spring 9 urges the plunger 7 downward, and urges the weight 8 upward. When the compression of the coil spring 9 is released, the resilient energy accumulated in the coil spring 9 urges the plunger 7 to move downward along the guide shaft 10, and urges the weight 8 to move upward. The coil spring 9 corresponds to a resiliently deformable member.

Figure 2:
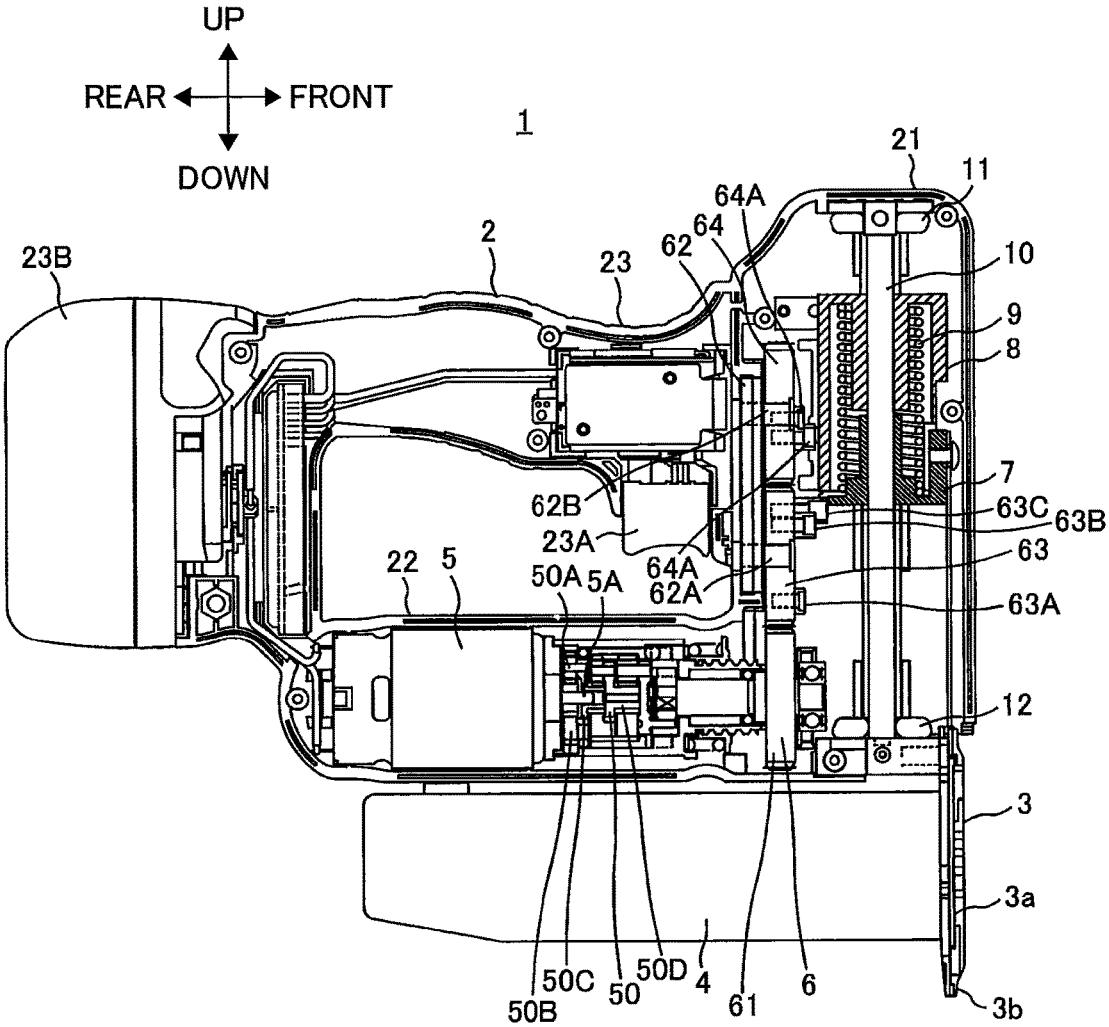

As shown in FIGS. 1 and 2, the nose portion 3 is positioned at a lower portion of the main body 21, and has an ejection hole 3*a* extending in the upward/downward direction. The ejection hole 3*a* has a lower end portion which functions as an ejection opening 3*b* for ejecting the nail therethrough.

The magazine 4 extends rearward from the rear portion of the nose portion 3 and accommodates therein a plurality of nails. The magazine 4 has a nail supplying mechanism for supplying the nail from the magazine 4 to the ejection hole 3*a* of the nose portion 3.

Operation of the nail fastening driver 1 will be described below.

Figure 7:
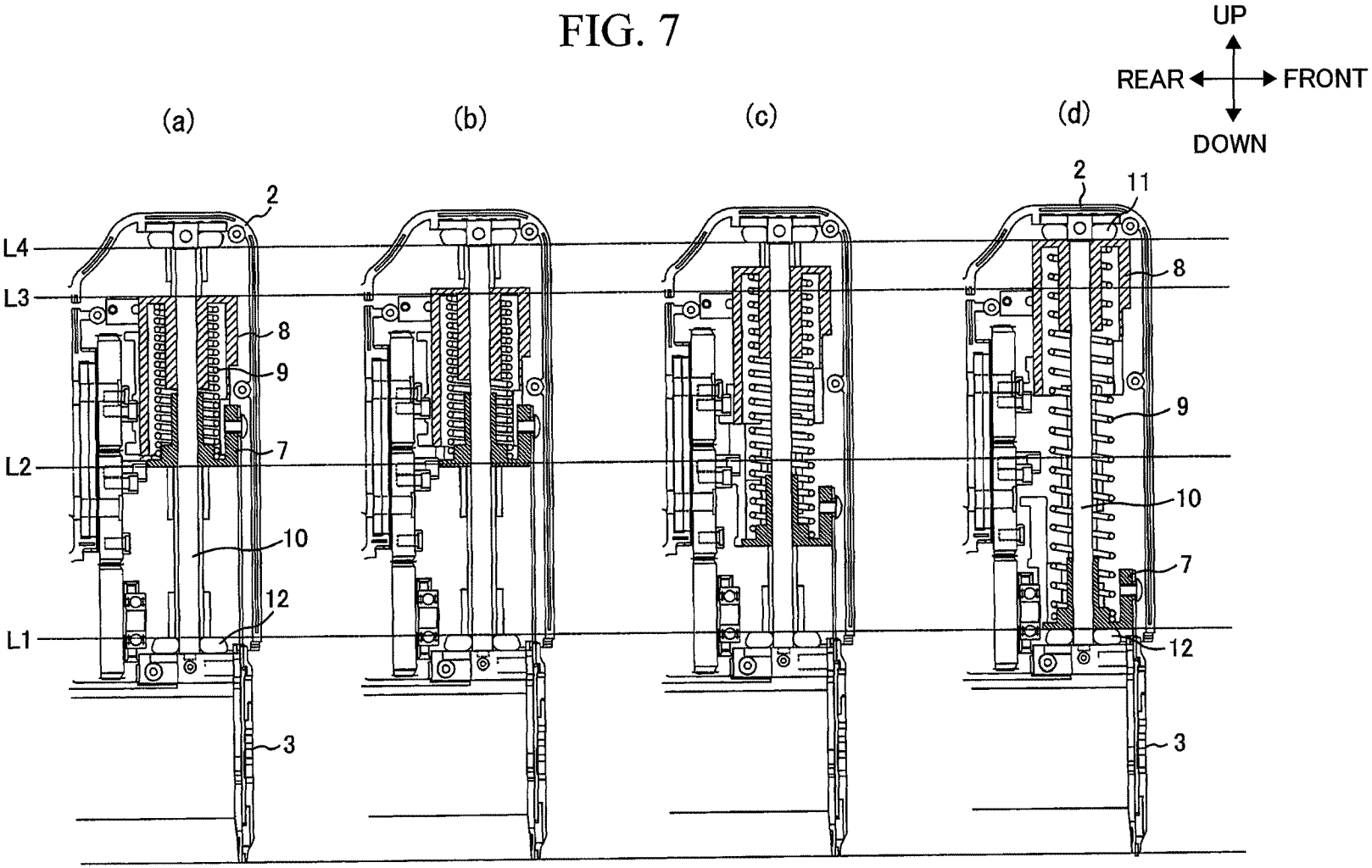

Before the operation, in other words, in the initial state of the nail fastening driver 1, as shown in FIG. 7, the plunger 7 is positioned at a bottom dead center L1 and in abutment with the plunger bumper 12, while the weight 8 is positioned at a topmost point L4 and in abutment with the weight bumper 11.

Figure 5:
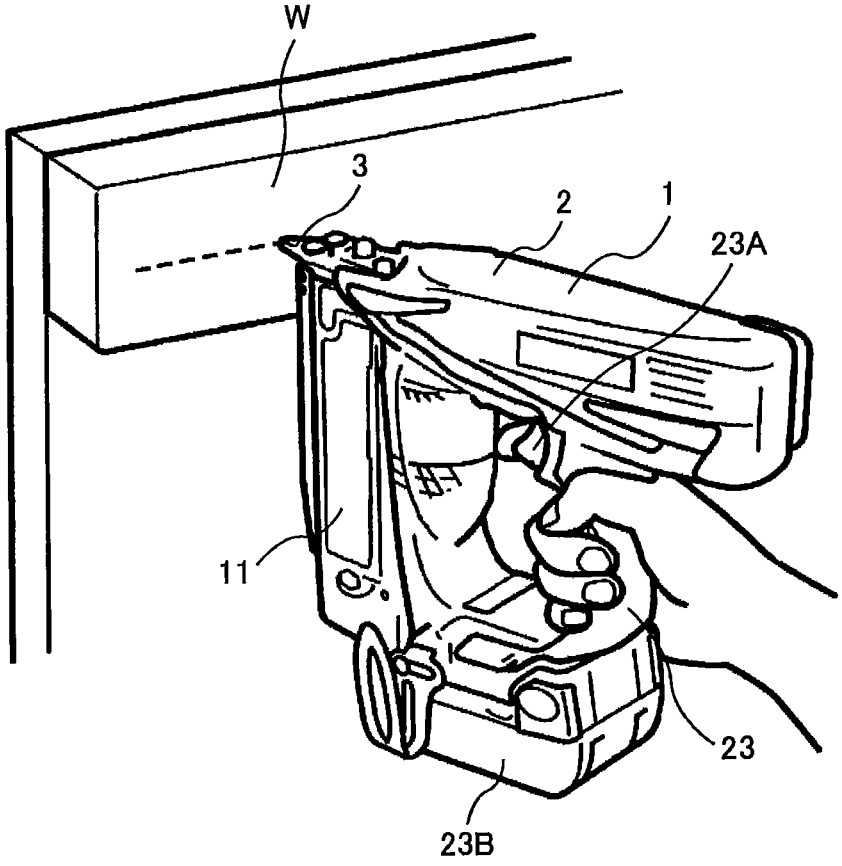
Figure 6:
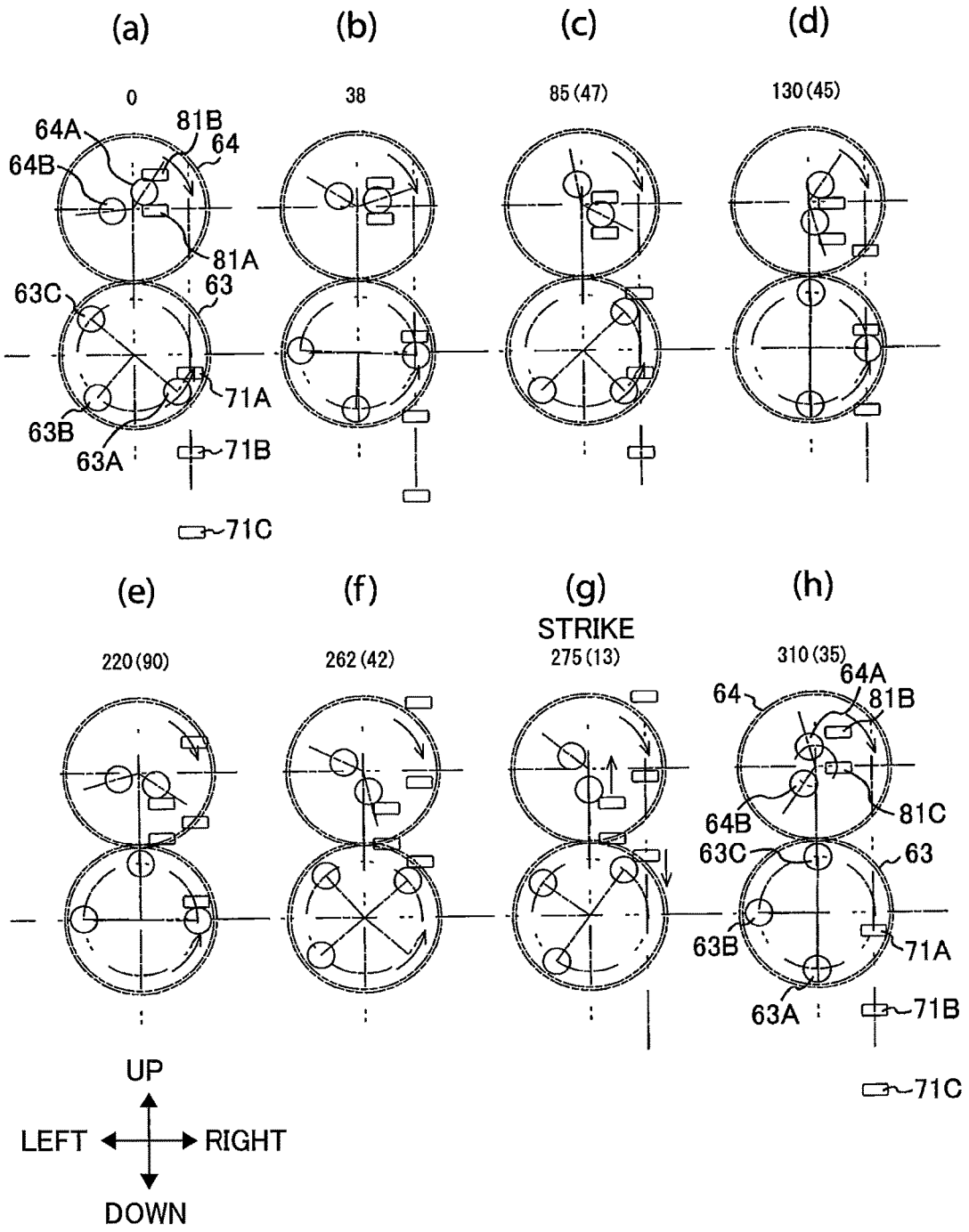

In the initial state, as shown in FIG. 5, a user grips and holds the handle portion 23, while urging the nose portion 3 against the upper surface of the workpiece W in a direction perpendicular to the upper surface. In this state pulling the trigger 23A causes the motor 5 to start rotating. When the motor 5 is rotated, the rotation shaft 5A is rotated, and driving power is transmitted through the deceleration mechanism 50 to the drive mechanism 6. In this state, as shown in FIG. 6(*a*), the first roller-cam 63A of the first gear 63 comes in abutment with the first abutment portion 71A of the plunger 7 from below. On the other hand, the first roller-cam 64A of the second gear 64 comes in abutment with the first abutment portion 81A of the weight 8 from above. The drive mechanism 6 causes the plunger 7 to move upward from the bottom dead center L1 to a top dead center L2 and causes the weight 8 to move downward from the topmost point L4 to a lowest point L3. The movement of the plunger 7 and the weight 8 compresses the coil spring 9. When the coil spring 9 is compressed to accumulate an resilient energy therein, the plunger 7 is urged downward, and the weight 8 is urged upward. The drive mechanism 6 forces the plunger 7 and the weight 8 to approach each other, countering the urging force generated by the coil spring 9.

The operation of each of the drive mechanism 6, the plunger 7, the weight 8, and the coil spring 9 will be described referring to FIGS. 6 and 7. The operation will be described as the first embodiment for simultaneously releasing the compression of the coil spring 9 by the plunger 7 and by the weight 8 and then simultaneously stopping the movements of the plunger 7 and the weight 8 after striking a nail. FIGS. 6(*a*) to 6(*h*) show the conditions of each element during one cycle from the start of the operation to the end of the operation after completion of striking the nail. A rotation angle of the first gear 63 or the second gear 64 is indicated in the upper portion of the each figure. The rotation angle is zero at the timing of the start of the operation (FIG. 6(*a*)). A number in brackets indicates an increment from the angle indicated in the left-positioned figure. It is noted that reference numerals are omitted in FIGS. 6(*b*) to 6(*g*). FIGS. 7(*a*) to 7(*d*) explain the states of the plunger 7 and the weight 8 in the housing 2, in which the plunger 7 is moved to the top dead center L2, and the weight 8 is moved to the lowest point L3, the compression of the coil spring 9 is released, and the operation for striking the nail is over in chronological order.

When the nail fastening driver 1 starts the operation, power is transferred from the motor 5 to the drive mechanism 6, and the first gear 63 starts rotating in the counter-clockwise direction. Simultaneously, the second gear 64 starts rotating in the clockwise direction. When the rotation angle is zero, as shown in FIG. 6(*a*), the first roller-cam 63A of the first gear 63 comes in abutment with the first abutment portion 71A of the plunger 7 from below and then starts pushing up the plunger 7. At the same time, the first roller-cam 64A of the second gear 64 comes in abutment with the first abutment portion 81A of the weight 8 from above and then starts pushing down the weight 8. Consequently, the compression of the coil spring 9 is started.

Next, as shown in FIG. 6(*b*), as the first gear 63 rotates, the plunger 7 is forced to be pushed up by the abutment between the first roller-cam 63A and the first abutment portion 71A. The weight 8 is forced to be pushed down by the abutment between the first roller-cam 64A and the first abutment portion 81A.

When the rotation angle comes to 85 degrees, as shown in FIG. 6(*c*), the pushing up of the plunger 7 is maintained by the abutment between the second roller-cam 63B of the first gear 63 and the second abutment portion 71B instead of the abutment between the first roller-cam 63A and the first abutment portion 71A. When the first gear 63 further rotates and the rotation angle reaches 130 degrees, as shown in FIG. 6(*d*), the pushing down of the weight 8 is maintained by the abutment between the second roller-cam 64B of the second gear 64 and the second abutment portion 81B instead of the abutment between the first roller-cam 64A and the first abutment portion 81A.

When the rotation angle reaches 220 degrees, as show in FIG. 6(*e*), the pushing up of the plunger 7 is maintained by the abutment between the third roller-cam 63C of the first gear 63 and the third abutment portion 71C instead of the abutment between the second roller-cam 63B of the first gear 63 and the second abutment portion 71B. In this manner, the pushing up of the plunger 7 and the pushing down of the weight 8 as shown in FIGS. 6(*a*) to 6(*e*) causes the plunger 7 and the weight 8 to approach each other gradually, so that the coil spring 9 is compressed from the both end portions thereof in its longitudinal direction to accumulate an resilient energy therein.

In the state shown in FIG. 6(*f*), as the third roller-cam 63C of the first gear 63 pushes up the third abutment portion 71C, the plunger 7 is positioned adjacent to the top dead center L2. On the other hand, as the second roller-cam 64B of the second gear 64 pushes down the second abutment portion 81B, the weight 8 is positioned adjacent to the lowest point L3 (See FIG. 7(*a*)). When each of the first gear 63 and the second gear 64 rotates more, as shown in FIG. 6(*g*), the abutment between the third roller-cam 63C and the third abutment portion 71C of the plunger 7 is released at the rotation angle of 275 degrees regarding the plunger 7. At the same time, the abutment between the second roller-cam 64B and the second abutment portion 81B is released regarding the weight 8 (See FIG. 7(*b*)). It spends 150 ms in this embodiment from the start of the compression of the coil spring 9 shown in FIG. 6(*a*) to the release of the compression shown in FIG. 6(*g*).

In other words, because the compression of the coil spring 9 is released as shown in FIG. 6(*g*), the accumulated resilient energy causes the plunger 7 to start moving downward as shown in FIG. 6(*h*) (See FIG. 7(*b*)). Simultaneously, the weight 8 is caused to start moving upward (See FIG. 7(*c*)). As the plunger 7 moves downward, the rod 13 strikes a nail, so that the nail is ejected through the nose portion 3. Here, a timing at which the plunger reaches the bottom dead center is approximately simultaneous with the timing at which the weight 8 reaches the upper limit position (the state in FIG. 7(*d*)). In this embodiment, 12 ms is required from the release timing of the compression of the coil spring 9 to the completion timing of the striking nail.

After that, the first gear 63 and the second gear 64 maintain rotating until the rotation angle reaches 360 degrees. Therefore, one cycle for the striking operation is completed.

According to the nail fastening driver 1 thus constructed, for striking a nail to a workpiece W, the plunger 7 which has been accelerated by the accumulated resilient energy in the coil spring 9 strikes the nail into the workpiece W. After striking the nail, because the energy which has not been used for striking the nail is transferred to the housing 2 through the plunger 7 and the plunger bumper 12, the housing 2 is urged to be moved in the direction toward the workpiece W. On the other hand, because the weight 8 is hit to the weight bumper 11 at the same time, the housing 2 is urged to be moved upward (the direction opposite to the direction toward the workpiece W). Accordingly, the movement of the power tool body (the nail fastening driver 1) due to the impact after striking the nail can be prevented.

Further, because the coil spring 9 allows the guide shaft 10 to be inserted therethrough between the plunger 7 and the weight 8, direct fixing of the coil spring to the housing 2 is not necessary. This structure makes the configuration of the nail fastening driver 1 to be simple.

Further, the stroke of the plunger 7, so-called, the distance between the bottom dead center L1 and the top dead center L2 can be changed by modifying the configurations of the first gear 63 and the second gear 64 constituting the drive mechanism 6, or by modifying positions of the first roller-cam 63A to third roller-cam 63C, the first roller-cam 64A, and the second roller-cam 64B provided on each gear, or by modifying positional relationship between the first roller-cam 63A, the second roller-cam 63B, and the third roller-cam 63C of the first gear 63 and the first roller-cam 64A and the second roller-cam 64B of the second gear 64, or modifying the shapes and/or weights of the plunger 7 and the weight 8 in a proper manner. Further, the moving speeds of the plunger 7 and the weight 8 can be set to different values. In a similar manner, the stroke of the weight 8, so-called, the distance between the topmost point L4 and the lowest point L3 can be changed. As a result, sufficient stroke of the plunger 7 which is necessary to strike a nail can be obtained, and the stroke of the weight 8 can be shortened. Therefore, the size of the nail fastening driver 1 in the upward/downward direction can be shortened to provide a compact driver.

Incidentally, in this embodiment, the weight 8 is heavier than the plunger 7, and the moving distance of the plunger 7 is set longer than the moving distance of the weight 8 during the striking operation. However, considering the weight relationship between the weight 8 and the plunger 7, the weight 8 and the plunger 7 are set to be struck on the weight bumper 11 and the plunger bumper 12, respectively, approximately simultaneously.

Next, a second embodiment will be described as follows. In the second embodiment, the compression of the coil spring 9 by the weight 8 is first released, and then the compression of the coil spring 9 by the plunger 7 is released. After the plunger 7 strikes a nail, the plunger 7 is first caused to impact on the plunger bumper 12, and then the weight 8 is caused to impact on the weight bumper 11, thereby ceasing the movement of the plunger 7 and the weight 8.

According to this operation, the weight 8 is separated from the housing 2, which prevents the load generated by the expansion of the coil spring 9 from being transferred to the housing 2. This operation prevents the tool body (the nail fastening driver 1) from being lifted upward.

Figure 8:
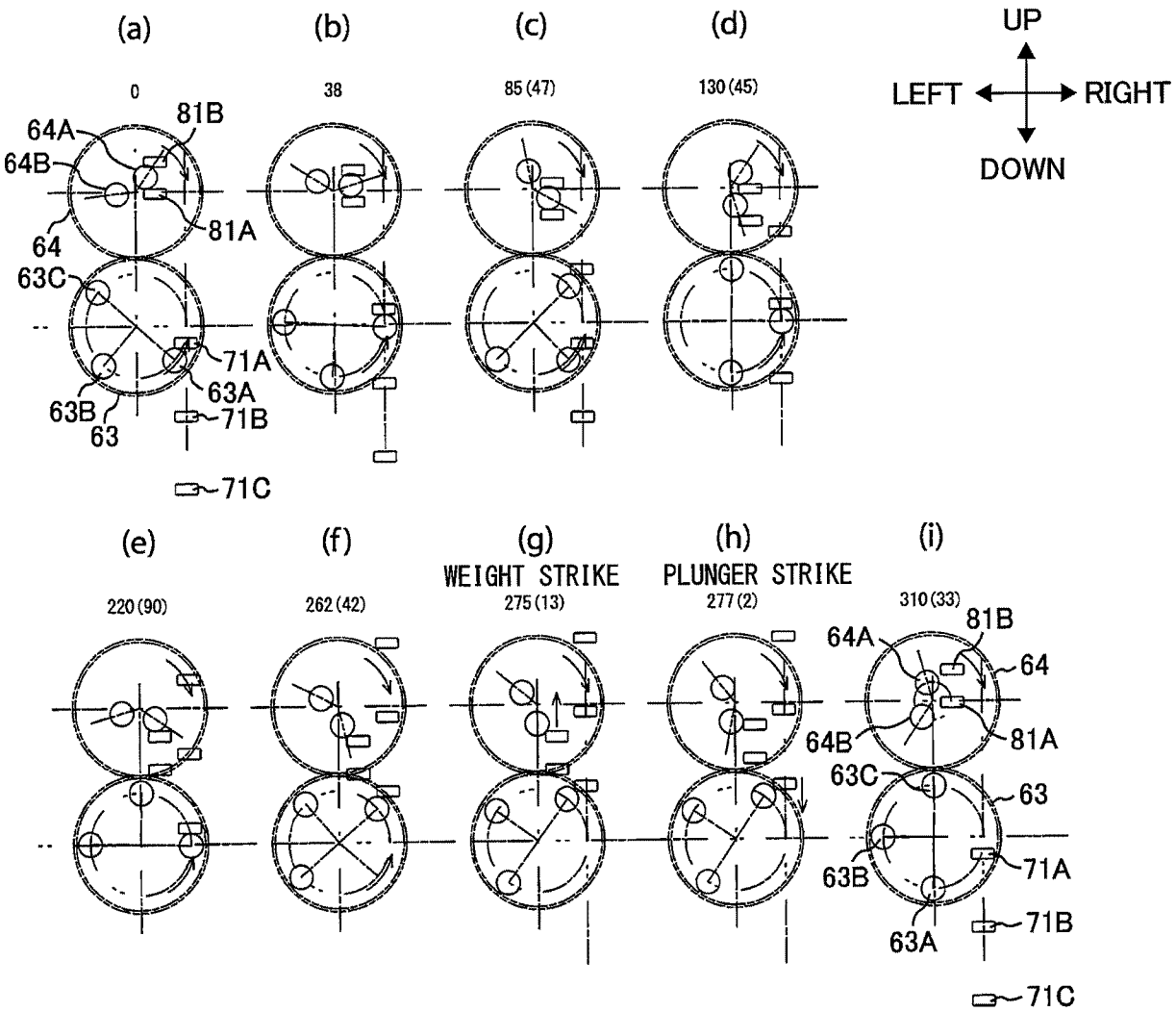
Figure 10:
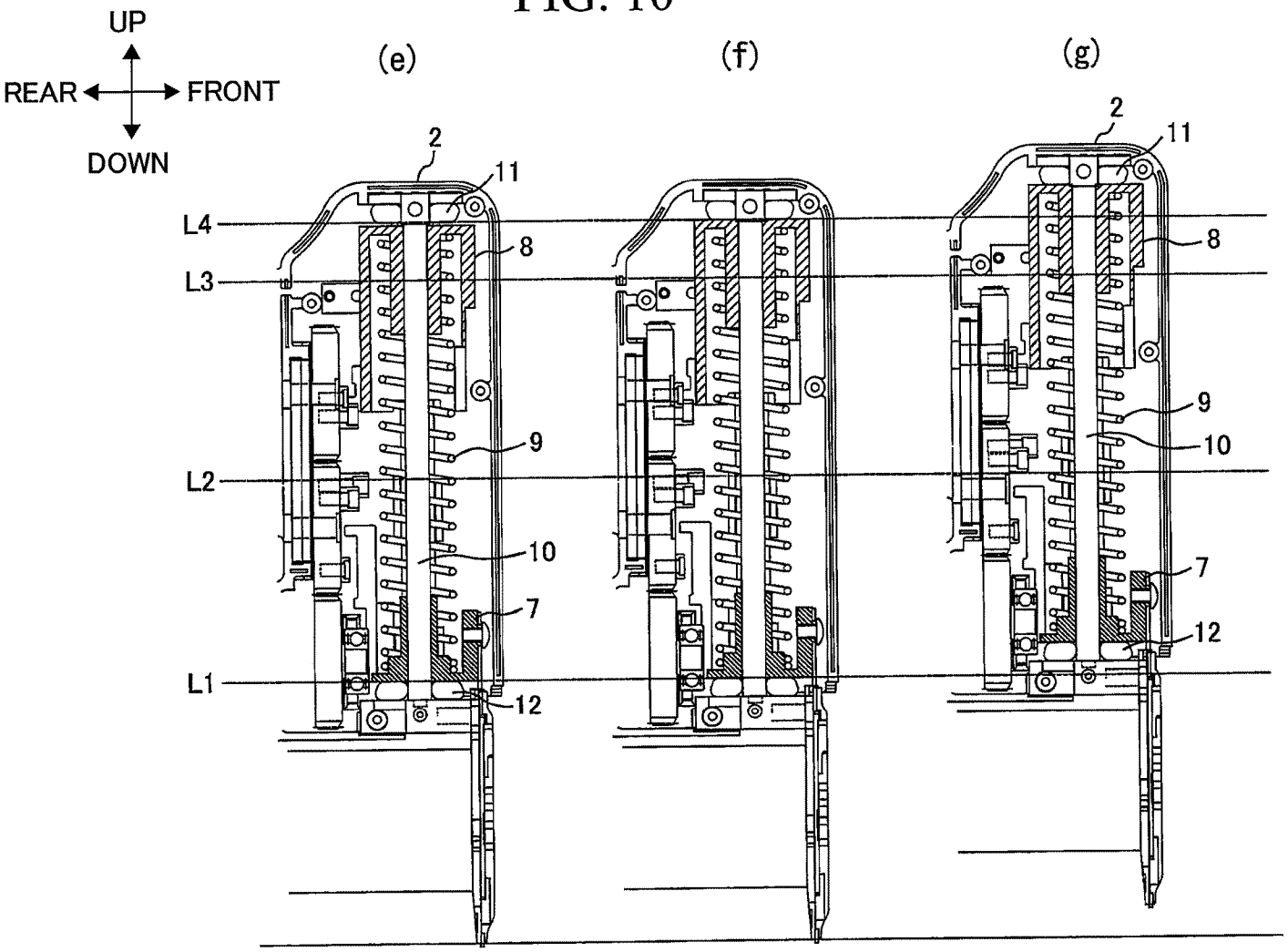

FIGS. 8(*a*) to 8(*i*) show the states of each elements from the start of the operation to the end thereof after striking a nail in chronological order. Each figure indicates a rotation angle of the first gear 63 and the second gear 64 in the upper part thereof. The rotation angle at the start of the operation is set zero (FIG. 8(*a*)). A number in brackets indicates an increment from the angle indicated in the left-positioned figure. Reference numerals are omitted in FIGS. 8(*b*) to 8(*h*). FIGS. 9 and 10 are explanatory diagrams showing the states of the plunger 7 and the weight 8 in the housing 2 in a consecutive period the plunger 7 is moved to the top dead center L2 and the weight 8 is moved to the lowest point L3, and the strike of the nail is over after releasing the compression of the coil spring 9. It should be noted that since the compression of the coil spring 9 shown in FIGS. 8(*a*) to 8(*f*) is the same as that of the first embodiment, the detailed explanation will be omitted.

In the state shown in FIG. 8(*f*), the plunger 7 is positioned adjacent to the top dead center L2, as the third roller-cam 63C of the first gear 63 urges the third abutment portion 71C upward. On the other hand, the weight 8 is positioned adjacent to the lowest point L3 (See FIG. 9(*a*)), as the second roller-cam 64B of the second gear 64 urges the second abutment portion 81B downward. From this state, when each of the first gear 63 and the second gear 64 further rotates, as shown in FIG. 8(*g*), the abutment between the second roller-cam 64B and the second abutment portion 81B is released at the rotation angle of 275 degree regarding the weight 8. Therefore, the weight 8 starts moving upward by the resilient energy of the coil spring 9. On the other hand, regarding the plunger 7, the abutment between the third roller-cam 63C and the third abutment portion 71C is maintained, so that the plunger 7 still moves up regardless of the urging to the coil spring 9 (See FIG. 9(*b*)).

When the rotation angle reaches 277 degrees, as the abutment between the third roller-cam 63C of the first gear 63 and the third abutment portion 71C is released as shown in FIG. 8(*h*), the compression of the coil spring 9 on the side of the plunger 7 is released. Accordingly, the plunger 7 starts moving downward because of the resilient energy of the coil spring 9 (See FIGS. 9(*c*) and 9(*d*)).

As shown in FIG. 8(*i*), in accordance with the downward movement of the plunger 7, the rod 13 strikes a nail, the nail is ejected through the nose portion 3, and the plunger 7 reaches the bottom dead center (See FIG. 10(*e*)). The above operation of the plunger 7 generates the force urging the housing 2 to the workpiece W. During the strike of the nail, all of a reaction force of the plunger 7 acts on the weight 8, so that any force other than an external force and gravity is not exerted to the housing 2.

Thereafter, the first gear 63 and the second gear 64 are kept rotating until the rotation angle reaches 360 degree.

According to the above-described operation of the nail fastening driver 1, before the plunger 7 is driven for the strike, the compression of the coil spring 9 is released from the weight 8 side and then the weight 8 is caused to start moving. Therefore, a force directing to the workpiece acts on the housing 2. As a result, the nail is driven to a desired position precisely without excessively urging the housing 2 toward the workpiece W more than necessary.

Incidentally, in this embodiment, the weight 8 is heavier than the plunger 7, the moving distance of the plunger 7 during the strike operation is longer than the moving distance of the weight 8, and the weight 8 is started moving earlier than the plunger 7. However, considering the weight relationship between the weight 8 and the plunger 7, the weight 8 and the plunger 7 are set to be hit on the weight bumper 11 and the plunger bumper 12, respectively, at the same time.

Further, the timing is adjusted in such a manner that the weight 8 impacts on the weight bumper 11 after the plunger 7 impacts on the plunger bumper 12. Due to the collision of the weight 8 to the weight bumper 11, a force in a direction away from the workpiece W acts on the housing 2. Accordingly, a roughening to a surface of the workpiece W due to the reaction force generated by the striking can be prevented.

The striking timing of the weight 8 and the plunger 7 and time period required to impinge on the bumper may be changed by properly modifying the configuration of the first gear 63 and the second gear 64 constituting the drive mechanism 6, by modifying the positions of the first roller-cam 63A to third roller-cam 63C, the first roller-cam 64A, the second roller-cam 64B positioned on each gear, by modifying positional relationship between the first roller-cam 63A, the second roller-cam 63B, and the third roller-cam 63C of the first gear 63, and the first roller-cam 64A, the second roller-cam 64B of the second gear 64, and by modifying the shapes and weights of the plunger 7 and the weight 8.

The distance between the top dead center and the bottom dead center of the plunger 7 may be properly determined in accordance with the length of the nail.

Further, in this embodiment, the weight of the plunger 7 is about 50 g, and the weight of the weight 8 is about 175 g. The weight ratio may be preferably about 1 to 4, and more preferably not less than 1 to 4.

Incidentally, the present invention may be applied to any type of electric power tool in which the coil spring 9 is provided between the plunger 7 and the weight 8 along the guide shaft, and the coil spring 9 is configured to urge the plunger 7 and the weight 8, and the coil spring 9 is compressed by the plunger 7 and the weight 8 to accumulate an resilient energy in the coil spring 9 for performing intended operation.

Further, in the above embodiments, the coil spring 9 is used as the resiliently deformable member. Alternatively, any type of resilient member other than the coil spring can be used as long as the resilient member can urge the plunger 7 in the impact direction and the weight 8 in the counter-impact direction.

REFERENCE SIGN LIST

1 . . . nail fastening driver, 2 . . . housing, 3 . . . nose portion, 7 . . . plunger, 8 . . . weight, 9 . . . coil spring, 11 . . . weight bumper, 12 . . . plunger bumper

The invention claimed is:

1. A driver comprising:

a nose portion provided in a housing and extending in a longitudinal direction, the nose portion being configured to allow a fastener to pass therethrough;

a plunger configured to move in an impact direction parallel to the longitudinal direction to impact the fastener through the nose portion;

a weight; and a resilient member configured to be compressed by a motor in the longitudinal direction, a release of the compression in the resilient member causing the plunger to move in the impact direction, while causing the weight to move in a counter-impact direction which is away from the plunger, and a drive mechanism configured to cause the motor to compress the resilient member in the longitudinal direction, the drive mechanism including a first gear and a second gear meshingly engaged with the first gear, the first gear and the second gear being configured to be rotated by the motor, each of the first gear and the second gear being provided with a plurality of roller-cams arranged in a circumferential direction at predetermined intervals, wherein the resilient member is provided between the plunger and the weight, the resilient member having one end portion and another end portion in the longitudinal direction, the one end portion being configured to urge the plunger, and the another end portion being configured to urge the weight, wherein rotation of the first gear and the second gear causes the plurality of roller-cams of the first gear to be in abutment with one of the plunger and the weight, while causing the plurality of roller-cams of the second gear to be in abutment with an other of the plunger and the weight, thereby compressing the resilient member in the longitudinal direction.

2. The driver according to claim 1, wherein the resilient member comprises a single coil spring.

3. The driver according to claim 1, wherein the drive mechanism is configured to release compression of the resilient member to cause the plunger to start moving in the impact direction, and simultaneously cause the weight to start moving in the counter-impact direction.

4. The driver according to claim 1, wherein the drive mechanism is configured to release compression of the resilient member from the another end portion to cause the weight to start moving in the counter-impact direction, and then the drive mechanism is configured to release compression of the resilient member from the one end portion to cause the plunger to move in the impact direction.

5. The driver according to claim 1, further comprising a weight restriction member provided in the housing and configured to restrict further movement of the weight in the counter-impact direction, wherein the weight is configured to be in abutment with the weight restriction member after the plunger strikes the fastener.

6. The driver according to claim 5, further comprising a plunger restriction member provided in the housing and configured to restrict movement of the plunger in the impact direction, wherein the plunger and the weight are provided in the housing in such a manner that a moving distance of the plunger to the plunger restriction member is set longer than a moving distance of the weight to the weight restriction member.

7. The driver according to claim 1, wherein each of the plurality of roller-cams of the first gear has a protruding length in an axial direction, the protruding length of each roller-cam of the first gear being different from each other, and each of the plurality of roller-cams of the second gear has a protruding length in an axial direction, the protruding length of each roller-cam of the second gear being different from each other.

* * * * *